US011754264B1

(12) United States Patent
Spinelli

(10) Patent No.: US 11,754,264 B1
(45) Date of Patent: Sep. 12, 2023

(54) PORTABLE ILLUMINATION APPARATUS

(71) Applicant: Steve Spinelli, Bedford, OH (US)

(72) Inventor: Steve Spinelli, Bedford, OH (US)

( * ) Notice: Subject to any disclaimer, the term of this patent is extended or adjusted under 35 U.S.C. 154(b) by 0 days.

(21) Appl. No.: 18/073,615

(22) Filed: Dec. 2, 2022

(51) Int. Cl.

| | |
|---|---|
| ***F21V 21/088*** | (2006.01) |
| ***F21V 21/30*** | (2006.01) |
| ***F21V 17/12*** | (2006.01) |
| ***F21S 9/02*** | (2006.01) |
| ***F21W 131/403*** | (2006.01) |

(52) U.S. Cl.
CPC ..... *F21V 21/088* (2013.01); *F21S 9/02* (2013.01); *F21V 17/12* (2013.01); *F21V 21/30* (2013.01); *F21W 2131/403* (2013.01)

(58) Field of Classification Search
CPC ..... F21V 21/088; F21V 33/0084
See application file for complete search history.

(56) References Cited

U.S. PATENT DOCUMENTS 5,873,647 A * 2/1999 Kurtz ..... B24C 5/02 362/101
11,351,564 B1 * 6/2022 Drewett ..... B05B 7/083
2007/0171031 A1 * 7/2007 Hastings ..... B60D 1/62 340/431
2007/0210749 A1 * 9/2007 Hsieh ..... H02J 7/342 320/114
2014/0153267 A1 * 6/2014 Georgitsis ..... F21V 29/763 362/430
2015/0131288 A1 * 5/2015 Zhang ..... F21S 8/00 362/277
2016/0341407 A1 * 11/2016 Manfred ..... F21V 21/0965
2018/0231195 A1 * 8/2018 Hoffman ..... F21V 23/003
2018/0231199 A1 * 8/2018 Chien ..... F21V 17/02
2018/0356078 A1 * 12/2018 Rolf ..... F21V 21/06
2022/0134366 A1 * 5/2022 Pieroni ..... B05B 7/066 239/8

OTHER PUBLICATIONS

Senvitate, Cell Phone Pouch, Cell Phone Holsters for Men Belt, Multi-Purpose Phone Belt Pouch, Phone Case Tool Holder, Tactical Molle Phone Pouch Carrying Case, Men's Waist Pocket for Hiking & Rescue, (Apr. 14, 2020), Amazon.com, (Year: 2020).*
Szrig-us, Kayulin Super Crab Clamp with 1/4"-20 & 3/8"-16 Mounting Points for Photo Studio Kit(2 Piece), (Mar. 23, 2020), Amazon.com (Year: 2020).*

(Continued)

*Primary Examiner* — Eric T Eide
(74) *Attorney, Agent, or Firm* — Kusner & Jaffe

(57) ABSTRACT

A portable illumination apparatus is provided for illumination of an area that is a target of a portable tool for work thereon. The apparatus includes a light head, a clamp, a personal mobile power supply, and a mobile mounting sleeve. The light head is configured to illuminate the target area. The clamp is configured allow the light head to be mounted thereon and secure the mounted light head to the portable tool. The personal mobile power supply is configured to supply the light head with power for the illumination of the target area by the light head. The mobile mounting sleeve is configured to receive the personal mobile power supply therein and secure the personal mobile power supply to an operator of the portable tool.

13 Claims, 5 Drawing Sheets

(56) References Cited

OTHER PUBLICATIONS

"SmallRig Super Clamp 2220", SmallRig website printout from https://www.smallrig.com/smallrig-super-clamp-2220.html, print out date Dec. 1, 2022.
"Tape Measure Utility Pouch with Quick Snap Magnetic Pencil Holder", The Home Depot website printout from http://www.homedepot.com/p/MagnoGrip-Tape-Measure-Utility-Pouch-with-Quick-Snap-Magnetic-Pencil-Holder-002-832/314522478, print out date Dec. 1, 2022.
"Chelhead Led Pod Lights, 2Pcs 2.8 Inch 20W Flood Cree Off Road Backup Driving Lights Fog Lamp Rear Bumpers Signal Reverse Light Bars Compatible with Trucks Jeep Motorcycle ATV UTV SUV Tacoma", Amazon Prime website printout from https://www.amazon.com/Samlight-Driving-Bumpers-Reverse-Motorcycle/dp/B07X9SL5T, print out date Dec. 1, 2022.

* cited by examiner

PORTABLE ILLUMINATION APPARATUS

FIELD OF THE INVENTION

The present invention relates generally to targeted illumination in industrial applications and, more particularly, to a portable illumination apparatus therefor.

BACKGROUND OF THE INVENTION

Illumination is a necessary component when applying any type of materials. For example, it is well known that, in order to properly coat a substrate, regardless of whether such a coating is manually facilitated by an operator or automated through use of optical equipment, the substrate must be illuminated to the extent that the operator or the optical equipment can recognize all of the details and characteristics of the substrate. This is especially the case in indoor coating applications such as, but not limited to, field painting of new or existing surfaces in both the commercial and residential market. Unfortunately, the requirements of such applications often interfere with the provision of adequate illumination of the target substrates.

For example, the spray application of indoor substrates in structures undergoing construction is often times required to be completed prior to a ceiling grid installation permanent lighting. However, the ceiling grid installation must be completed prior to the installation of light fixtures that could be used for illumination of target substrates. As a result, temporary lighting devices are required to properly illuminate field finished substrates in structures undergoing construction. For example, head lamps are often mounted on hardhats worn by painters during the coating process of substrates in environments having insufficient ambient lighting for a spray application to properly occur. In addition, temporary light towers or other similar lighting mechanisms are often used in an attempt to provide a sufficient amount of ambient lighting to enable operators to properly coat substrates.

However, there are significant drawbacks in using head lamps for additional illumination of substrates in such environments. Specifically, the light sources included in such head lamps are often inadequate to produce a necessary amount of lumens to sufficiently illuminate a target substrate. As such, a more concentrated beam of light is typically required to be emitted from head lamps. This results in a beam of light that is more focused, which subsequently leads to significant operator fatigue, as the head of an operator must be moved more often to make up for the scope of lighting that is reduced in exchange for the provision of additional lumens. Further, as head lamps are required to be positioned on an operator's head to be effective, the battery supply that is provided therewith is smaller and lighter, thereby resulting in shorter periods of operator coating and, subsequently, an inefficient coating process.

Light towers also have drawbacks, as the needs of substrate illumination changes throughout the coating application. As such, it is important for light towers to have freedom of movement. However, light towers are typically powered through wires that are connected to a power source. The wired connection to a power source significantly decreases the extent to which a light tower is free to move and restricts the range of a light tower to the length and flexibility of the wires, especially since light towers are in constant need of repositioning to minimize shadows that can occur on the target substrates. As can be expected, efforts to maximize the operation range of a light tower increase the likelihood of wires that transfer the power to the light tower becoming unplugged, resulting in additional inefficiencies.

Further, the spray lines used to transfer a coating source to a coating apparatus often become tangled with the extension cords dedicated to providing power to the light sources. This can result in further application inefficiencies, such as coating errors, industrial tripping hazards for operators, and damage to the light sources after being toppled.

The invention is designed to address these conventional drawbacks.

SUMMARY OF THE INVENTION

In an example embodiment of the invention, a portable illumination apparatus is provided for illumination of an area that is a target of a portable tool for work thereon. The apparatus includes a light head, a clamp, a personal mobile power supply, and a mobile mounting sleeve. The light head is configured to illuminate the target area. The clamp is configured to allow the light head to be mounted thereon and secure the mounted light head to the portable tool. The personal mobile power supply is configured to supply the light head with power for the illumination of the target area by the light head. The mobile mounting sleeve is configured to receive the personal mobile power supply therein and secure the personal mobile power supply to an operator of the portable tool.

The present invention provides a portable illumination apparatus with a light head that supplies necessary lighting required to successfully perform work on a target area, such as application of coatings to a substrate, in an environment where sufficient ambient lighting to properly apply such coatings is not available.

The present invention further provides a portable illumination apparatus with a light head that can be universally and directly mounted to portable tools for illumination of target areas in order to reduce the need for excessive movement of other means of personal, portable, or temporary lighting in industrial environments that are not local to the respective portable tools.

The present invention further provides a portable illumination apparatus with a lightweight design to allow for extended periods of operation without necessitating rest on the part of the operator of the portable tool.

The present invention further provides a portable illumination apparatus that is able to eliminate shadows that would be created on a target area utilizing other illumination means and provide an even emission of light corresponding with the orientation of the portable tool.

The present invention further provides the only solution that allows the illumination apparatus to be mounted directly to the spray gun between the operator and the substrate, thus eliminating shadows.

These and other advantages will become apparent from the following description of a preferred embodiment taken together with the accompanying drawings and claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
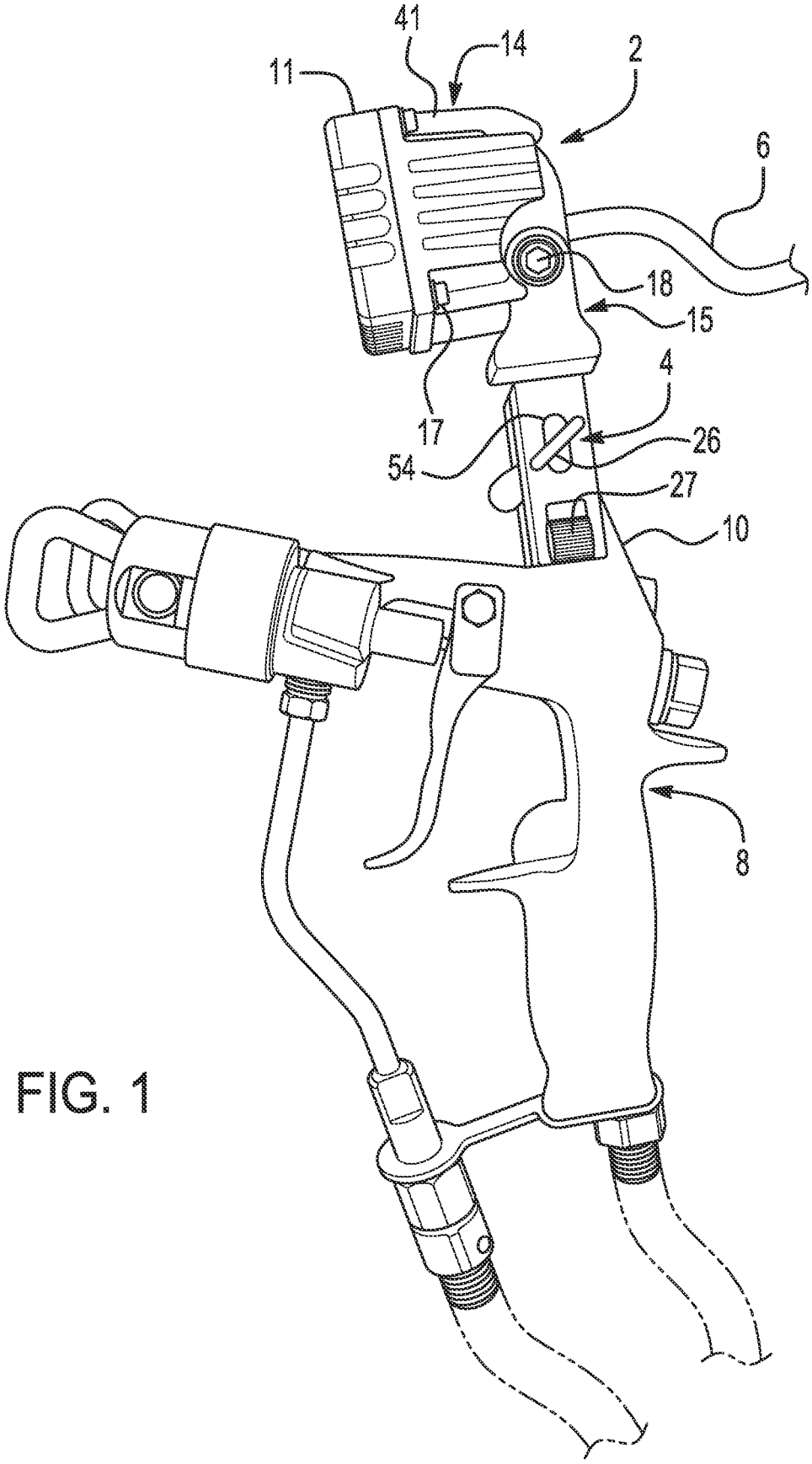
FIG. 1 is a side view of an example of a lamp of a portable illumination apparatus according to an embodiment of the present invention mounted by a clamp on a portable tool.
Figure 2:
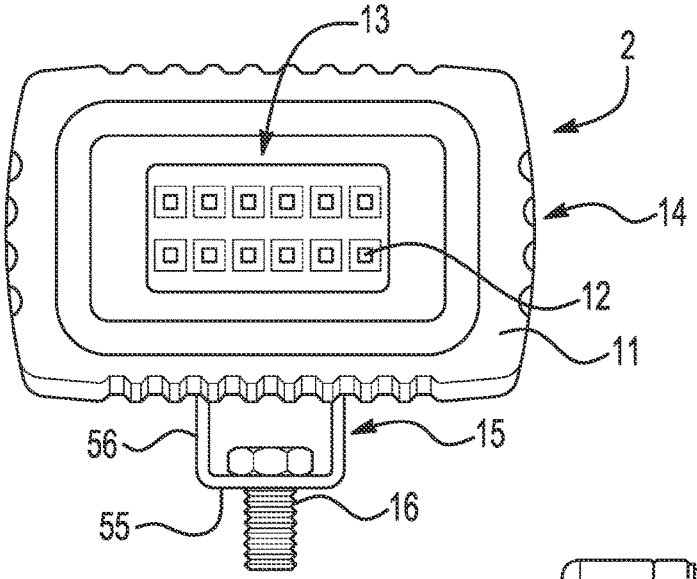
FIG. 2 is a front view of an example of a lamp of the portable illumination apparatus according to an embodiment of the present invention.
Figure 3:
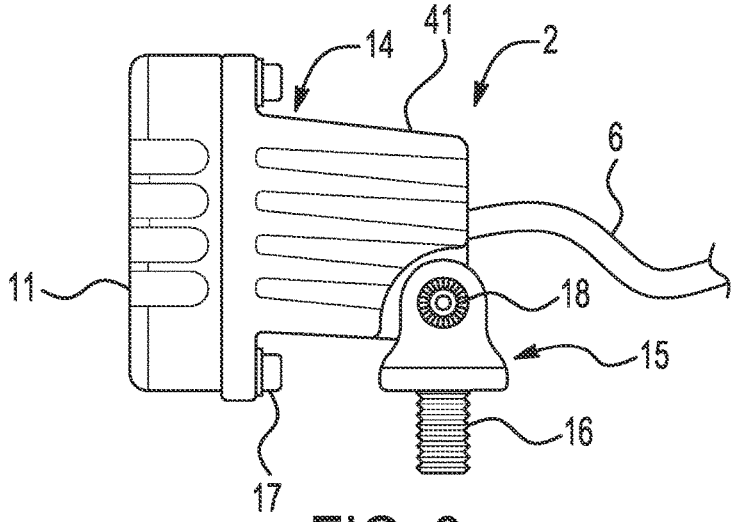
FIG. 3 is a side view of an example of a lamp of the portable illumination apparatus according to an embodiment of the present invention.
Figure 4:
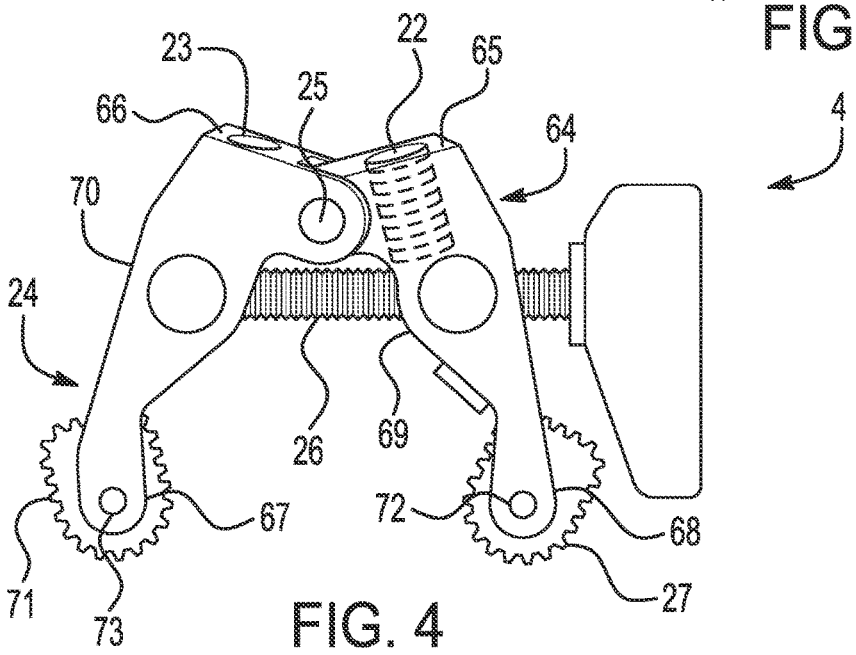
FIG. 4 is a front view of an example of a clamp of the portable illumination apparatus according to an embodiment of the present invention.

Referring now to the drawings, wherein the showing is for illustrating a preferred embodiment of the invention only and not for limiting same, various embodiments of the invention will be described.

FIGS. 1-10 illustrate various aspects of an example of a portable illumination apparatus corresponding with an embodiment of the present invention. The portable illumination apparatus is for illumination of an area 47 that is a target of a portable tool 8 for work thereon.

Figure 10:
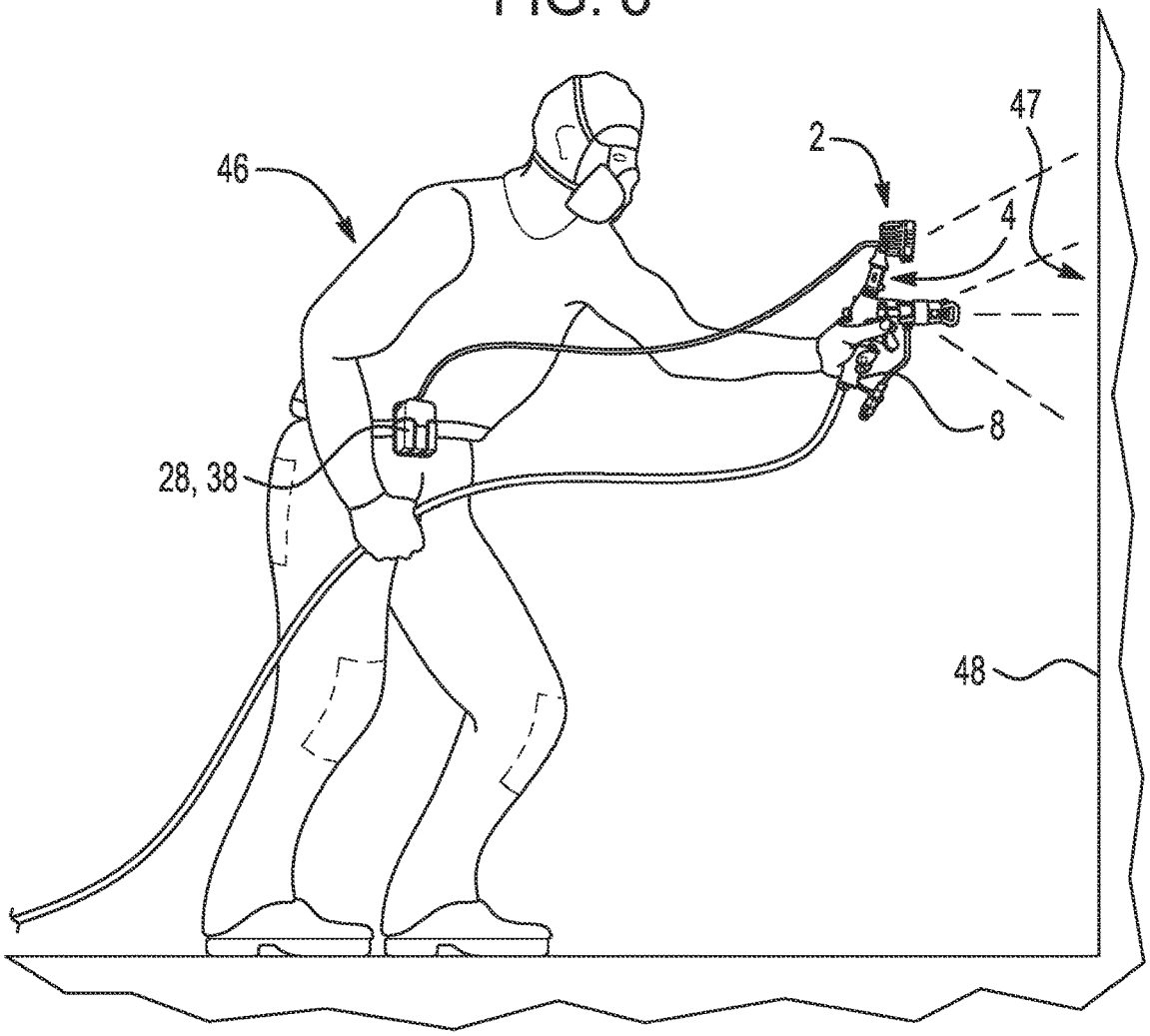
FIG. 10 is a plan view of an example of the portable illumination apparatus when in use according to an embodiment of the present invention.
Figure 9:
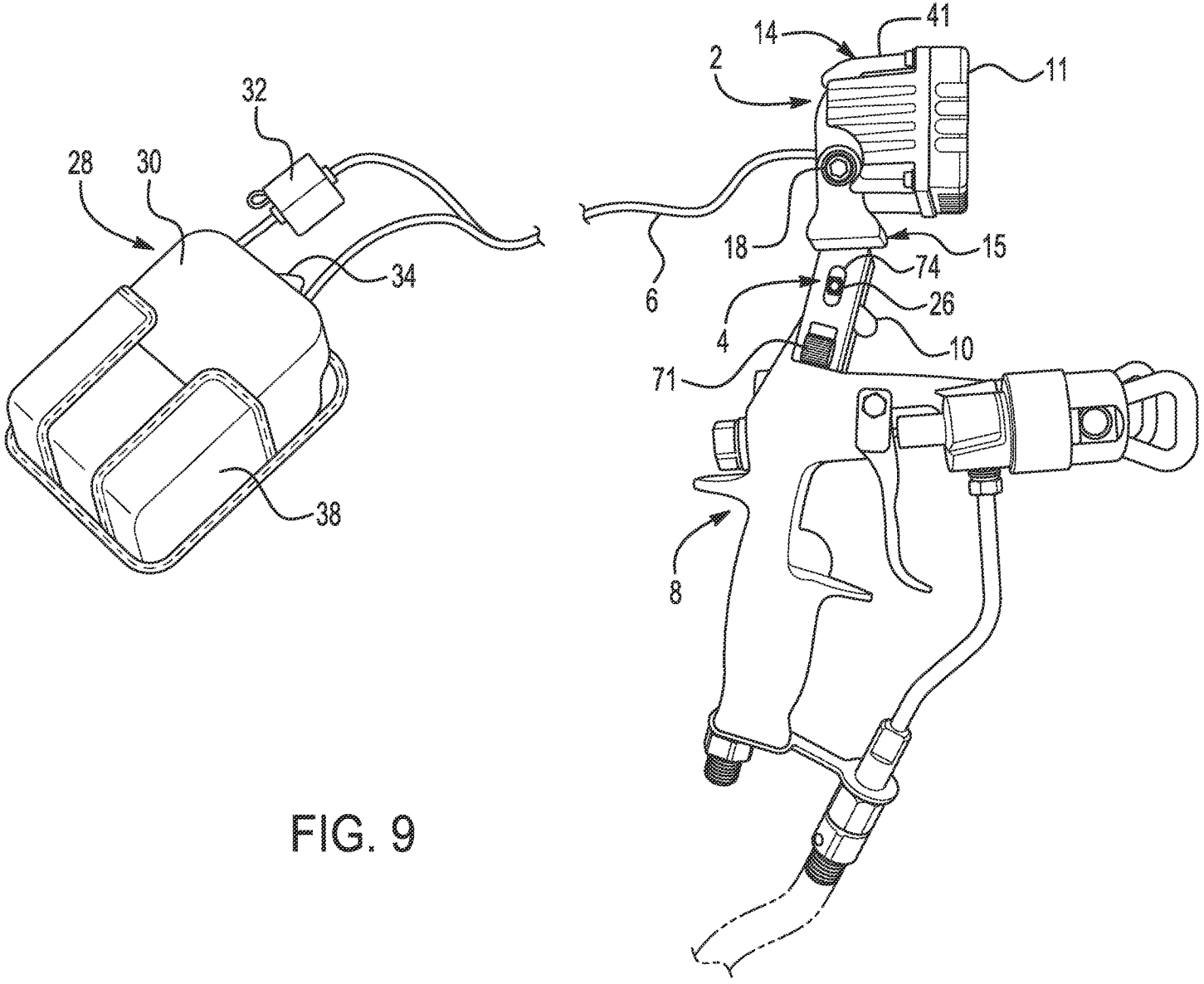
FIG. 9 is a schematic view of an example of the portable illumination apparatus according to an embodiment of the present invention.

An example of the target area 47 is best illustrated in FIG. 10, which further illustrates an example environment in which the portable illumination apparatus may be applied. In this case, and in most cases, the target area 47 is a defined area of a substrate 48. In the example illustrated in FIG. 10, the substrate 48 resembles a wall. However, embodiments described herein are not limited thereto. The substrate 48 can be representative of any surface on which a portable tool 8 may perform work. Such surfaces include, but are not limited to, indoor and outdoor flooring, HVAC ducting and/or installations, molding, table surfaces, and printed circuit boards and/or semiconductors, architectural trim, moldings, casements, door frames, window frames, cabinets, and ceilings.

Further, while the target area 47 is contemplated as being an area of a substrate 48, embodiments described herein are not limited thereto. For example, the target area 47 may be any area on which a portable tool 8 may perform work. Such areas may include, but are not limited to, areas in need of soldering or repair, areas in which surfaces must be joined or separated, spatial areas, areas related to microscopy, and structural areas positioned on a substrate 48.

The portable tool 8 shown in FIG. 10 is contemplated as being a spray gun for spraying a coating, such as paint, onto the target area 47. However, embodiment described herein are not limited thereto. For example, the portable tool 8 may be any type of portable tool used in industrial or household applications for which enhanced illumination of a target area 47 may be desired, such as, but not limited to, a nail gun, an electric screwdriver, a drill, a glue gun, a soldering means, a lithographical apparatus, and sputtering means.

Moreover, while it is contemplated according to FIG. 10 that an operator 46 of the portable illumination apparatus and the portable tool 8 would be a human being, embodiments described herein are not limited thereto. For example, an operator 46 can be a machine using cameras and sensors to perform work, thereby also requiring proper illumination for the cameras and sensors to function properly. Such a machine may be or may need to be mobile, in which case, as will be described below, the portable illumination apparatus is able to be attached to the machine.

The portable illumination apparatus described herein includes a light head 2, a clamp 4, a personal mobile power supply 28, and a mobile mounting sleeve 38. The light head 2 illuminates the target area 47. The clamp 4 allows the light head 2 to be mounted thereon and secures the mounted light head 2 to the portable tool 8. The personal mobile power supply 28 supplies the light head 2 with power for the illumination of the target area 47 by the light head 2. The mobile mounting sleeve 38 receives the personal mobile power supply 28 therein and secures the personal mobile power supply 28 to an operator 46 of the portable tool 8.

Specifically, the light head 2 includes a light source 12, a housing 14, and a neck 15. The light source 12 emits light for the illumination of the target area 47. Light emitting diodes may be used as the light source 12. The light emitting diodes may be mounted in the housing 14 to emit the light. However, embodiments described herein are not limited thereto, as the light emitted by the light source 12 may be provided by any lamp or group of lamps capable of emitting a desired amount of light toward the target area 47 while being appropriately sized for mounting in the housing 14 and using appropriate lighting technology for industrial environments.

The housing 14 houses the light source 12 and allows transmission of the emitted light toward the target area 47. The housing includes a base 41 to which the light source 12 is mounted and a cover 11 removably fastened to the base 41. The base 41 has an aperture (not shown) formed therein through which wires 6 connect to the light source 12 to supply power thereto.

The housing 14 may be formed of any suitable material for industrial applications, such as, but not limited to, metals and plastics. It is also important to consider the density of the material used to form the housing 14 and the design of the light head 2 with respect to the ability to balance the light head 2 when mounted on the portable tool 8. For example, in example embodiments, such as the embodiment illustrated in FIG. 10, the portable tool 8 is to be designed such that the work with the portable tool 8 can be performed through single-handed or single-clamped operation of the portable tool 8 by the operator 46, regardless of whether the operator 46 is human or machine. As such, it is important for the weight of the light head 2 to be such that the operator 46 is allowed to perform work using the portable tool 8 with a single hand or a single clamp when the light head 2 is mounted thereon. The mounting of the light head 2 onto the portable tool 8 will be addressed further in the discussion below.

The cover 11 may be fastened to the base 41 via fasteners 17 that can extend through portions of the base 41 and be threaded into bores (not shown) formed in the cover 17. The fasteners 17 may be bolts or screws. However, embodiments disclosed herein are not limited thereto. For example, the fasteners 17 may be any type of securing mechanism known by those having ordinary skill in the art to be appropriate for industrial applications and light enough to enable single-handed operation of the. Further, the design by which the fastening is achieved is not limited to the above-referenced description. For example, any fastening means or method known to be appropriate for the industrial application can be employed to fasten the cover 11 to the base 41. Such means or method may utilize clamps instead of holes, bolts, and bores to achieve fastening of the cover 11 to the base 41. As noted above, the ability to operate the portable tool 8 as intended could be influenced by the weight of the light head 2, which includes the fasteners 17.

The cover 11 includes a transparent window 13 integrated therein. The transparent window 13 allows the transmission of the light emitted from the light source 12 therethrough toward an area at which the transparent window 13 is facing, which is assumed to be the target area 47. The transparent window 13 may be formed of any suitable material for transmission of light in industrial applications, such as, but not limited to, glass and plastic, again in consideration of density and design as suggested above.

The neck 15 enables the housing 14 to be mounted on the clamp 4. The neck 15 includes a platform 55 and a pair of wings 56 positioned on opposite ends of the platform 56. The wings 56 extend perpendicularly from the platform 55 and parallel with each other. Each of the wings 56 has an aperture (not shown) formed therethrough.

The wings 56 are attached to the housing 14 via a wing fastener 18. The wings 56 may have apertures (not shown) formed therein through which portions of the wing fastener 18 may extend. One example configuration of the wing fastener 14 may include a rod (not shown) that extends through each of the apertures (not shown) and through a channel (not shown) formed in the housing 14. The rod (not shown) may have threaded ends (not shown) around which nuts (not shown) may be threaded, thereby securing the wings 56 to the housing 14.

The housing 14 is rotatable about an axis of the wing fastener 18, thereby allowing for the positioning of the housing 14 to be adjusted for the effective transmission of the light emitted from the light source 12 therethrough toward an area at which the transparent window 13 is facing, i.e. the target area 47.

As the use of the light head 2 is for illumination of the target area 47, it follows that, if oriented properly, i.e. in an orientation corresponding with the focus of the portable tool 8, the transparent window 13 would allow the emitted light transmitted therethrough to be transmitted toward the target area 47 for illumination thereof in furtherance of the work to be performed on the target area 47 by the portable tool 8, regardless of what work the portable tool 8 is configured to perform. This orientation can be performed by the operator 46, which has been broadly defined in previous discussion, or through other means.

The apparatus further includes a bolt 16 extends through the platform 55. The platform 55 may include a hole (not shown) through which the bolt 16 may extend. The bolt 16 may also be integrated into the platform 55.

The clamp 4 includes a first arm 64, a second arm 24, and a threaded pin 26. The first arm 64 has a first end 65, a second end 68 that is on an opposite side of the first arm 64 from the first end 65, and a middle portion 69 that is positioned between the first end 65 and the second end 78. The first end 65 of the first arm 64 has a threaded bore 22 formed therein. The bolt 16 threadably extends into the threaded bore 22 of the first arm 64 to secure the light head 2 to the clamp 4. The second end 68 of the first arm 64 has a first foot 27 attached thereto. The middle portion 69 of the first arm 64 has a first threaded channel 54 formed therethrough.

The second arm 24 has a first end 66, a second end 67 on an opposite side of the second arm 24 from the first end 66, and a middle portion 70 positioned between the first end 66 and the second end 67. The second arm 24 has a second foot 71 attached thereto. The middle portion 70 of the second arm 24 has a second threaded channel 74 formed therethrough. The second arm 24 is connected to the first arm 64 at a hinge 25 having an axis about which the second arm 24 is rotatable.

The threaded pin 26 threadably extends through the first threaded channel 54 and into the second threaded channel 74. The threaded pin 26 is rotatable about its axis within the first threaded channel 54 and the second threaded channel 74 to adjust a position of the second arm 24 with respect to the first arm 64 until teeth of the first foot 27 are mated with teeth of the second foot 71.

In practice, the clamp 4 is designed to mount the light head 2 to a structure. It is foreseeable that the clamp 4 could mount the light head to ladders, hooks, and other structure that might exist in industrial environments. In the example embodiment described herein, the clamp 4 mounts the light head 2 to a flange 10 of the portable tool 8. More particularly, the flange 10 is positioned between the first arm 64 and the second arm 24 of the clamp 4. After this, the threaded pin 26 is rotated clockwise within the first threaded channel 54 and the second threaded channel 74 to rotate the second arm 24 of the clamp 4 closer to the first arm 64 of the clamp 4.

Eventually, the first arm 64 and the second arm 24 will be close enough that teeth of the first foot 27 of the first arm 64 will contact the teeth of the second foot 71 of the second arm 24. The first foot 27 of the first arm 64 is connected to the second end 68 of the first arm 64 by a hinge 72 within which the first foot 27 may rotate. The second foot 71 of the second arm 24 is connected to the second end 67 of the second arm 24 by a hinge 73 within which the second foot 71 may rotate. As the threaded pin 26 continues to be rotated clockwise, the first foot 27 and the second foot 71 will respectively rotate within the hinges 72, 73 until the teeth of the first foot 27 mate with the teeth of the second foot 71. At this point, the threaded pin 26 will no longer be able to rotate. The mating of the teeth of the first foot 27 with the teeth of the second foot 71 is effective to close the clamp 4, thereby securely mounting the light head 2 on the flange 10 of the portable tool 8.

In another embodiment, the first end 66 of the second arm 24 has a threaded bore 23 formed therein. The threaded bore 23 of the second arm 24 could conceivably replace the threaded bore 22 of the first arm 64. On the contrary, the threaded bore 23 of the second arm 24 could be used to mount another device on the clamp 4. Such a second device could include, but is not limited to, another light head similar to the light head 2 described herein that would complement the illumination of the target area 47 provided by the light head 2, a camera to capture the work performed by the portable tool 8 for instructional or troubleshooting review, and a securing structure configured to provide more stability to the light head 2 mounted on the clamp 4.

Figure 5:
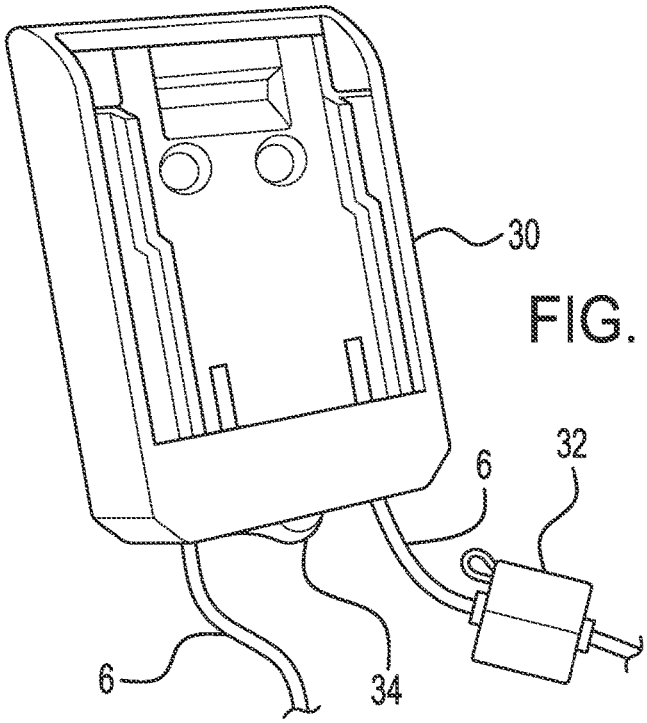
FIG. 5 is a plan view of an example of a personal mobile power supply of the portable illumination apparatus according to an embodiment of the present invention.
Figure 6:
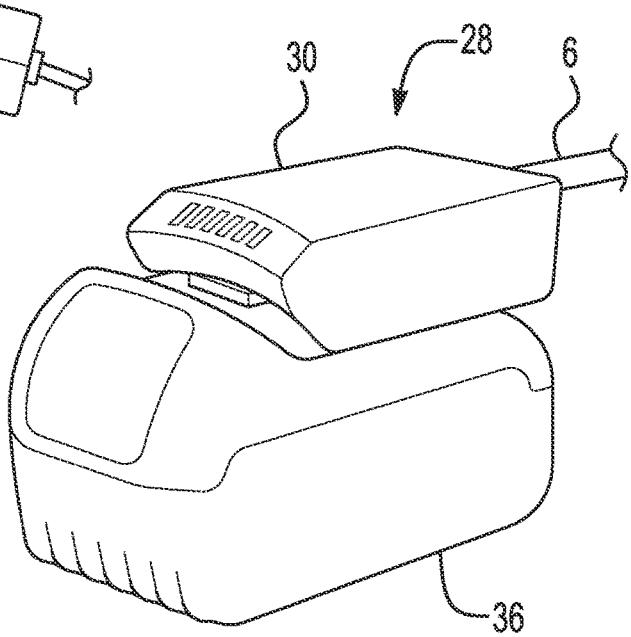
FIG. 6 is another plan view of an example of the personal mobile power supply of the portable illumination apparatus according to an embodiment of the present invention.

The personal mobile power supply 28 is connected to the light source 12 via the wires 6 to supply power to the light source 12. The personal mobile power supply 28 includes a battery 36, a transformer 30, and a switch 34. The battery 36 provides a source of the power. The battery 36 may be both removable and rechargeable, as is illustrated in FIGS. 5 and 6. However, embodiments described herein are not limited thereto.

Figure 7:
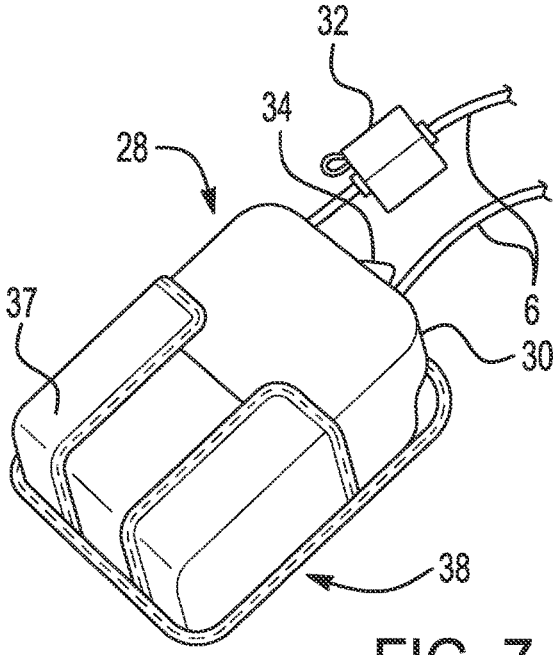
FIG. 7 is a plan view of an example of the personal mobile power supply being received in a mobile mounting sleeve of the portable illumination apparatus according to an embodiment of the present invention.

In accordance with FIGS. 5 and 6, the transformer 30 receives the battery 36 and transforms the power provided by the battery 36 to the wires 6 to supply the power to the light source 12. An in-line fuse 32, as is illustrated in FIGS. 5 and 7, may be positioned on the wires 6 to inhibit power surges from damaging the light source 12.

A switch 34 is positioned on the transformer 30. The switch 34 activates or deactivates the supply of the power to the light source 12 to respectively cause the light source 12 to emit light or inhibit the light source 12 from emitting light. The switch 34 may be a rocker switch enabling basic activation and deactivation. The switch 34 may also be a dimmer switch that controls an amount of power supplied to the light source 12, thereby controlling an amount of the light emitted by the light source 12 according to a setting of the switch 34.

The mobile mounting sleeve 38 includes a pocket 37 and a clip 44. The pocket 37 receives and holds the personal mobile power supply 28. The clip 44 is positioned on a rear side 42 of the pocket 37. The clip 44 secures the mobile mounting sleeve 38 to an object 40 attached to the operator 46 of the portable tool 8 to secure the personal mobile power supply 28 to the operator 46 of the portable tool 8.

Figure 8:
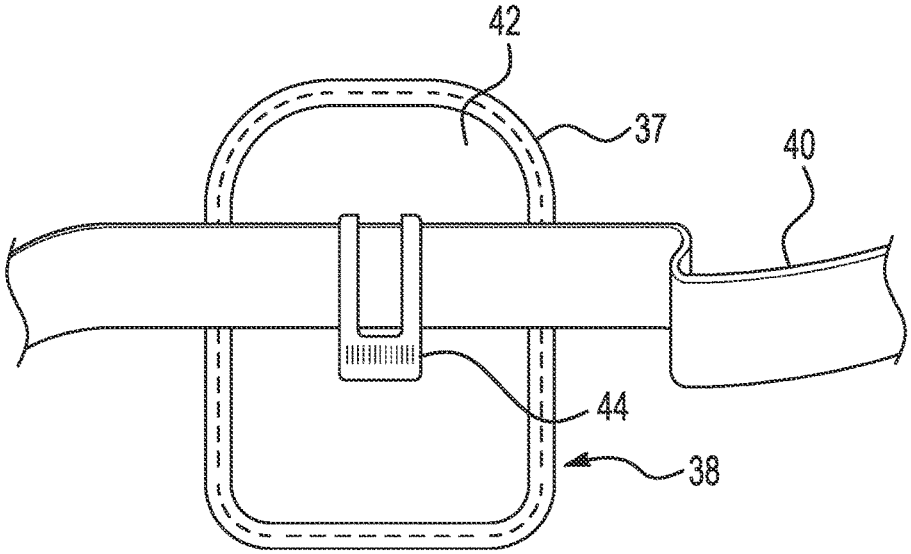
FIG. 8 is a rear view of an example of the mobile mounting sleeve of the portable illumination apparatus according to an embodiment of the present invention.

The clip 44 is illustrated in FIG. 8 as being a belt clip that secures the pocket 37 to a belt 40 worn by the operator 46. However, embodiments described herein are not limited thereto. For example, the clip 44 may be secured to a pocket included on clothing worn by the operator 46. It is also conceivable that the clip 44 need not be used, as the mobile mount sleeve 38 holding the personal mobile power supply 28 could be placed within a pocket included on clothing worn by the operator 46. It is additionally conceivable that the clip 44 could be alternatively formed to attach the mobile mounting sleeve 38 and the personal mobile power supply 28 to an arm of the operator 46, similar to, for example, an arm band.

The mounting of the light head 2 on the portable tool 8 via the clamp 4 enables illumination of the target area 47 in a way that minimizes shadowing or obstruction of illumination of the target area 47, as the light head 2 is optimally positioned to focus its illumination of the target area 47. This is enhanced through the ability of the housing 14 of the light head 2 to rotate about the neck 15, thereby enabling positioning of the transparent window 13 in a way that maximizes transmission of the light emitted by the light source 12 toward the target area 47.

Further, power is portably provided by the personal mobile power supply 28 that can move with the operator 46 during the use of the portable tool 8, thereby enabling power to be provided to the light source 12 without the physical obstructions that wiring might incur if power was provided to the light source 12 from a location remote to that of the operator 46 and the light source 12.

The foregoing descriptions regard specific embodiments of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A portable illumination apparatus for illumination of an area that is a target of a portable tool for work thereon, the apparatus comprising:

a light head configured to illuminate the target area, the light head comprising a light source configured to emit light therefrom when supplied with power;

a clamp configured to allow the light head to be mounted thereon and secure the mounted light head to the portable tool;

a personal mobile power supply configured to supply the light source with the power, the personal mobile power supply comprising:

a rechargeable battery configured to provide a source of the power; and a transformer connected to the light source via wires, the transformer being configured to receive the rechargeable battery therein and transform the power from the rechargeable battery through the wires to supply the light source with the power; and a mobile mounting sleeve configured to receive the personal mobile power supply therein and secure the personal mobile power supply to an operator of the portable tool, wherein the rechargeable battery is removable from the transformer, and wherein the rechargeable battery is received in the transformer.

2. The apparatus according to claim 1, wherein the light head further comprises:

a housing configured to house the light source and allow transmission of the emitted light toward the target area; and a neck configured to allow attachment of the housing thereto and enable mounting of the housing on the clamp.

3. The apparatus according to claim 2, wherein the light source comprises a plurality of light emitting diodes configured to emit the light, the light emitting diodes being mounted in the housing.

4. The apparatus according to claim 2, wherein the housing comprises:

a base to which the light source is mounted; and a cover removably fastened to the base, the cover comprising a transparent window integrated therein, the transparent window being configured to allow the transmission of the emitted light toward the target area.

5. The apparatus according to claim 4, wherein the base has an aperture formed therein through which the wires connect to the light source.

6. The apparatus according to claim 2, wherein the neck comprises:

a platform; and a pair of wings positioned on opposite ends of the platform, the wings extending perpendicularly from the platform and parallel with each other, the wings being attached to the housing via a wing fastener, and wherein the housing is rotatable about an axis of the wing fastener.

7. The apparatus according to claim 6, further comprising a bolt configured to extend through the platform, wherein the clamp comprises:

a first arm having a first end, a second end on an opposite side of the first arm from the first end, and a middle portion positioned between the first end and second end, the first end having a threaded bore formed therein, the second end having a first foot attached thereto, the middle portion having a first threaded channel formed therethrough;

a second arm having a first end, a second end on an opposite side of the second arm from the first end, and a middle portion positioned between the first end and second end, the second end having a second foot attached thereto, the middle portion having a second threaded channel formed therethrough, the second arm being connected to the first arm at a hinge having an axis about which the second arm is rotatable; and a threaded pin configured to threadably extend through the first threaded channel and into the second threaded channel, the threaded pin being configured to rotate about its axis within the first and second threaded channels to adjust a position of the second arm with respect to the first arm until teeth of the first foot are mated with teeth of the second foot, and wherein the bolt is configured to threadably extend into the threaded bore of the first end to secure the light head to the clamp.

8. The apparatus according to claim 1, wherein the personal mobile power supply further comprises a switch positioned on the transformer, the switch being configured to activate the supply of the power to the light source.

9. The apparatus according to claim 8, wherein the switch is a dimmer switch configured to control an amount of the power supplied to the light source, thereby controlling an amount of the light emitted by the light source.

10. The apparatus according to claim 1, wherein an in-line fuse is positioned in the wires, the in-line fuse configured to inhibit a surge of the power through the wires.

11. The apparatus according to claim 1, wherein the mobile mounting sleeve comprises:

a pocket that is configured to receive and hold the personal mobile supply therein; and a clip positioned on a rear side of the pocket, the clip being configured to secure the mobile mounting sleeve to an object attached to the operator of the portable tool, thereby securing the personal mobile power supply to the operator of the portable tool.

12. The apparatus according to claim 7, wherein the first end of the second arm has a threaded bore formed therein.

13. The apparatus according to claim 7, wherein, when a flange of the portable tool is positioned between the arms, the mating of the teeth of the first foot with the teeth of the second foot clamps the light head to the portable tool.

* * * * *